US006217192B1

(12) United States Patent
Stratton

(10) Patent No.: US 6,217,192 B1
(45) Date of Patent: Apr. 17, 2001

(54) DECORATIVE LIGHT STRING SUPPORT

(76) Inventor: Linard S. Stratton, 4309 Meadowlark Ter., Edmond, OK (US) 73034

( * ) Notice: Subject to any disclaimer, the term of this patent is extended or adjusted under 35 U.S.C. 154(b) by 0 days.

(21) Appl. No.: 09/323,233

(22) Filed: Jun. 1, 1999

(51) Int. Cl.[7] ..... F21V 21/00
(52) U.S. Cl. ..... 362/249; 362/396
(58) Field of Search ..... 362/249, 250, 362/252, 396

(56) References Cited

U.S. PATENT DOCUMENTS

| | | | | |
|---|---|---|---|---|
| 4,795,121 | * | 1/1989 | Comito | 248/314 |
| 5,161,882 | | 11/1992 | Garrett | 362/249 |
| 5,469,344 | | 11/1995 | Kotsakis | 362/145 |
| 5,544,028 | | 8/1996 | Carlin | 362/249 |
| 5,707,136 | | 1/1998 | Byers | 362/145 |
| 5,842,773 | * | 12/1998 | Krebs | 362/249 |
| 5,848,838 | * | 12/1998 | Presta | 362/249 |
| 6,033,088 | * | 3/2000 | Contigiani | 362/249 |
| 6,050,703 | * | 4/2000 | Herbert | 362/250 |
| 6,068,389 | * | 5/2000 | Lai | 362/398 |

* cited by examiner

*Primary Examiner*—Sandra O'Shea
*Assistant Examiner*—Ronald E. DelGizzi
(74) *Attorney, Agent, or Firm*—Robert K. Rhea

(57) ABSTRACT

A decorative trim light supporting apparatus is formed by an elongated resilient strip having a series of longitudinally spaced apertures therethrough. Strip fasteners projecting through selected apertures removably anchor the strip to a surface. Friction gripping bulb socket supports are removably received by other apertures.

8 Claims, 1 Drawing Sheet

DECORATIVE LIGHT STRING SUPPORT

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to lighting and more particularly to a system for mounting decorative lighting on buildings or the like.

1. Field of the Invention

It is common practice for attaching decorative lights to a home or other structure by suspending the electric conductor for the lights on nails or hooks driven or screwed into the siding material of the structure. The light string is then placed on the nails or hooks by resting the same to hang by gravity thereon at spaced apart intervals. One drawback to such installation is the reluctance of some homeowners to mar the surface of their structure by driving nails at close intervals into a wall surface. Another drawback is that the lights so attached are easily dislodged as, for example, by wind gusts. It is therefore desirable that some means of providing a mounting strip for decorative lights, such as Christmas lights, which may remain attached to the structure, if desired, and the lamps and sockets may be readily removed therefrom.

2. Description of the Prior Art

U.S. Pat. No. 5,469,344 issued Nov. 21, 1995 to Kotsakis for SUPPORT FOR DECORATIVE LIGHT STRING ON A BUILDING. This patent discloses an elongated member which may be attached to a building and is provided to a series of longitudinally spaced openings having inwardly projecting prongs which removably grip and hold lamp containing sockets when placed therein.

U.S. Pat. No. 5,544,028 issued Aug. 6, 1996 to Carlin for LIGHT SYSTEM WITH LIGHT HOLDER. This patent discloses an elongated section of plastic material having a flat base and upwardly converging flexible side walls which resiliently grip a lamp bulb socket containing a lamp when interposed between the side walls.

U.S. Pat. No. 5,161,882 issued Nov. 10, 1992 to Garrett for CHRISTMAS LIGHTING ORGANIZER APPARATUS and U.S. Pat. No. 5,707,136 issued Jan. 13, 1998 to Byers for MULTIPLE LIGHT SYSTEMS are believed good examples of the further state-of-the-art. The Garrett patent discloses an elongated housing having mounting flanges for securing the housing to a surface, the housing including a plurality of spaced sockets in electrical communication with each other which receive a like series of lamps. The Byers patent disposes an elongated strip or track which holds a similarly elongated string of lights provided with snap fasteners which may be snap attached to the mounting strip.

This invention is believed distinctive over the above named prior patents by providing a strap-like transversely apertured support of construction and attaching its mounting strip, removably supporting decorative lamps and sockets.

SUMMARY OF THE INVENTION

An elongated strap-like length of material having a series of transverse apertures in longitudinally equally spaced relation, forms a lamp string support. The support is flatly attached to a structure by a series of cooperating equally spaced apart members attached to the structure which snap into the several apertures on the support. A series of lamp socket receiving members are similarly inserted at one end into other apertures on the support. A like series of lamp socket containing lamps, interconnected by elongated strands of electrical conductive wiring, are cooperatively received by the lamp socket members on the support, thus permitting the series of lamps and sockets to be removed as a unit or with the attached mounting strip for storage.

The principal objects of this invention are to provide a decorative Christmas tree lamp supporting apparatus including a lamp mounting strip which may be temporarily or permanently attached to a structure by a snap and socket arrangement, and which receives lamp socket holding members which may be snapped into the mounting strip and removably receive lamp sockets containing lamps and mounting strip to be removed as a unit, or separately.

DETAILED DESCRIPTION OF THE INVENTION

Figures 1, 2, 3, 4:
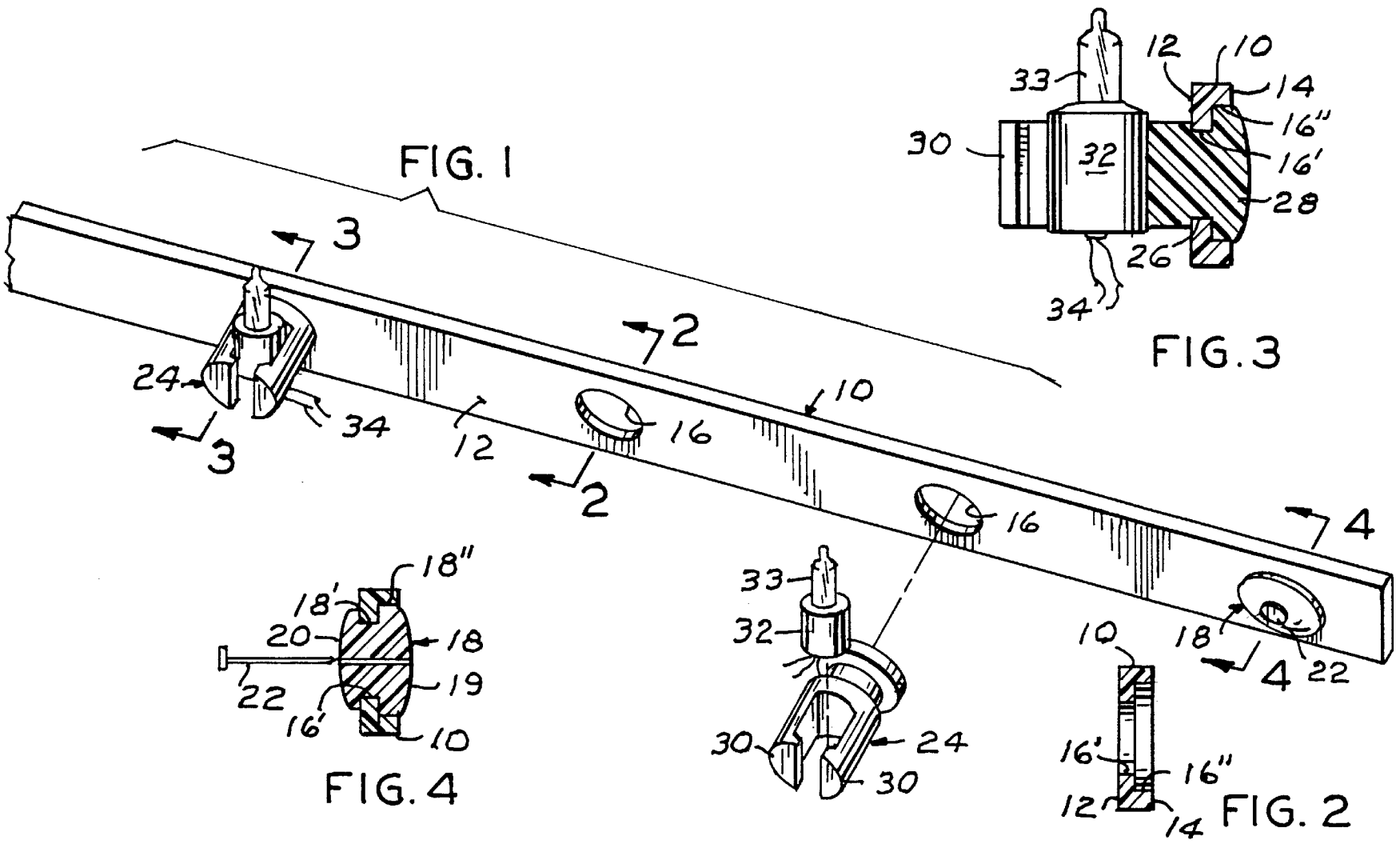
FIG. 1 is a fragmentary perspective view of a section of a string of lamps support with parts shown in exploded relation for clarity; and, FIGS. 2, 3 and 4 are vertical cross sectional views, to a larger scale, taken respectively along the lines 2—2, 3—3 and 4—4 of FIG. 1.

Like characters of reference designate like parts in those figures of the drawings in which they occur.

In the drawings:

The reference numeral 10 indicates a fragment of an elongated mounting member having a forward surface 12, a rearward surface 14 and preferably formed of vinyl plastic capable of being deflected and returning to a position of repose.

Mounting member 10 is provided with a plurality of longitudinally spaced step diameter apertures 16, each aperture having a larger diameter 16' open toward its rearward surface 14 and a smaller diameter 16" open toward its forward surface 12. The mounting member 10 is secured to a building or other structure with its rearward surface 14 facing the structure by a plurality of fastening means 18 herein referred to as "buttons".

Each of the buttons 18 are characterized by opposite end flanges 19 and 20 and having a central neck portion 18' peripherally nested by the small aperture diameter 16'. The periphery 18' of the end flange 19 is nested by the aperture diameter 16", the flange 19 being characterized by a substantially dome like end surface as illustrated by FIG. 4. The opposite flange 20 is diametrically slightly larger than the aperture diameter 16'. One of the buttons 18 is inserted into selected mounting member apertures 16, the button being axially provided with a through aperture for receiving a fastener such as a nail 22. Alternatively, the button flanged end 19 may be secured to the structure surface as by bonding, not shown if preferred, rather than an object penetrating the structure wall.

The reference numeral 24 indicates a substantially cylindrical lamp supporting friction means having its major portion diametrically slightly greater than the respective aperture diameter 16'. A smaller diameter portion or neck 26, substantially diametrically equal with the aperture diameter 16', is integral with a terminal end flange 28, having a diameter substantially equal with the aperture diameter 16".

The end portion of the lamp mounting member 24 opposite its end flange 28 is bifurcated to define a pair of legs 30 which resiliently partially surround and grip the perimeter of a lamp base 32 having an ornamental Christmas tree style low voltage lamp 33 therein. The lamp base 32 is operatively connected with a source of electrical energy by conductors 34.

OPERATION

A plurality of the lamp mounting members 24 are axially manually inserted into selected apertures 16. A like plurality of lamps 33 are support by the legs 30 of the lamp holding member 24 by inserting the lamp base 32 between the legs 30. Similarly, a second plurality of the buttons 18 are axially inserted into the respective available wall apertures 16, as explained herein above. The buttons 18 are then secured to the structure, not shown, by the nails 22, or bonding if desired. Thereafter, the wires 34 are connected with a source of electrical energy.

When it is desired to remove the lighting assembly, the entire assembled unit may be removed from the structure by separating the mounting strip 10 from the respective buttons 18 and placed in a suitable storage. Alternatively, only the lamps and sockets, with the wires 34, may be removed from the lamp holders 24, leaving the mounting member 10 and lamp holders secured to the structure by the buttons 18. obviously the invention is susceptible to changes or alterations without defeating its practicability. Therefore, I do not wish to be confined to the preferred embodiment(s) shown in the drawing(s) and described herein.

What is claimed is:

1. Support apparatus for a segment of a string of decorative lights in lamp bulb sockets spaced along a conductor for decorating a building structure, said apparatus comprising:

an elongated strap-like member having forward and rearward side surfaces and having a plurality of longitudinally spaced step diameter apertures therethrough;

a plurality of flanged end fastening means axially projecting through selected apertures of said plurality of apertures for securing said member to a structure; and, a plurality of cylindrical friction means having one end portion cooperatively received by a like plurality of other apertures of said plurality of apertures and having an opposite bifurcated end portion defining laterally spaced legs for respectively frictionally gripping opposite surfaces of a like plurality of said lamp bulb sockets when disposed therebetween.

2. The apparatus according to claim 1 in which said fastening means includes:

a generally cylindrical member having a diametrically reduced intermediate portion peripherally nested by the respective selected aperture; and, opposing end flanges diametrically slightly greater than the diameter of the selected aperture.

3. The apparatus according to claim 2 and further including:

a nail axially securing the respective fastening means to a structure.

4. The apparatus according to claim 2 and further including:

bonding means axially securing the respective fastening means to a structure.

5. The apparatus according to claim 2 in which said friction means includes:

a cylindrical member having a diametrically reduced portion adjacent said one end portion peripherally nested by the respective said other aperture of said plurality of other apertures.

6. Support apparatus for a segment of a string of decorative lights in lamp bulb sockets spaced along a conductor and decorating a building structure, said apparatus comprising:

a elongated member having forward and rearward side surfaces and having a plurality of longitudinally spaced apertures therethrough;

a plurality of fastening means projecting through selected apertures of said plurality of apertures for securing said member to a structure; and, a plurality of friction means having an end portion cooperatively received by a like plurality of other apertures of said plurality of apertures and having an opposite bifurcated end portion for respectively frictionally gripping opposite surfaces of a like plurality of said lamp bulb sockets when disposed therebetween.

7. The apparatus according to claim 6 in which said fastening means includes:

a generally cylindrical member having a diametrically reduced intermediate portion peripherally nested by the respective selected aperture; and, opposing end flanges diametrically slightly greater than the diameter of the selected aperture.

8. The apparatus according to claim 7 in which said friction means includes:

a cylindrical member having a diametrically reduced portion adjacent said one end portion peripherally nested by the respective said other aperture of said plurality of other apertures.

* * * * *